US007699237B2

(12) United States Patent
Berkenkoetter et al.

(10) Patent No.: US 7,699,237 B2
(45) Date of Patent: Apr. 20, 2010

(54) METHOD FOR CONTROLLING THE EXHAUST FLOW FROM A COOKING CHAMBER OF A BAKING OVEN

(75) Inventors: Herbert Berkenkoetter, Oelde (DE); Ulrich Sillmen, Guetersioh (DE)

(73) Assignee: Miele & Cie. KG, Guetersloh (DE)

( * ) Notice: Subject to any disclaimer, the term of this patent is extended or adjusted under 35 U.S.C. 154(b) by 405 days.

(21) Appl. No.: 11/850,859

(22) Filed: Sep. 6, 2007

(65) Prior Publication Data

US 2008/0066661 A1 Mar. 20, 2008

(30) Foreign Application Priority Data

Sep. 14, 2006 (DE) ..... 10 2006 044 039

(51) Int. Cl.
*F23L 17/00* (2006.01)

(52) U.S. Cl. ..... 236/1 G; 126/21 R; 126/285 R

(58) Field of Classification Search ..... 236/1 G, 236/15 A, 46 D, 49.3; 126/21 R, 285 R, 126/286, 290, 285 B; 454/339, 341, 347, 454/258

See application file for complete search history.

(56) References Cited

U.S. PATENT DOCUMENTS

| | | | | |
|---|---|---|---|---|
| 4,208,572 | A * | 6/1980 | Melgaard | 219/400 |
| 4,608,961 | A * | 9/1986 | Lanham et al. | 126/21 A |
| 6,216,683 | B1 * | 4/2001 | Maughan | 126/19 R |
| 6,555,791 | B2 * | 4/2003 | Lubrina et al. | 219/400 |
| 6,756,570 | B2 * | 6/2004 | Sauter | 219/492 |
| 7,223,944 | B2 * | 5/2007 | Kitabayashi et al. | 219/413 |
| 7,420,140 | B2 * | 9/2008 | Lenhart et al. | 219/412 |
| 2002/0179588 | A1 * | 12/2002 | Lubrina et al. | 219/400 |
| 2006/0090741 | A1 * | 5/2006 | Bowles et al. | 126/41 R |
| 2008/0066732 | A1 * | 3/2008 | Berkenkoetter et al. | 126/21 A |
| 2008/0149088 | A1 * | 6/2008 | Inada et al. | 126/21 R |

FOREIGN PATENT DOCUMENTS

| | | |
|---|---|---|
| DE | 2518750 | 11/1976 |
| DE | 3804678 | 8/1989 |
| DE | 10211522 | 9/2003 |
| DE | 10218792 | 11/2003 |
| EP | 1156282 | 11/2001 |

* cited by examiner

*Primary Examiner*—George Nguyen
(74) *Attorney, Agent, or Firm*—Darby & Darby

(57) ABSTRACT

A baking oven and a method for controlling the exhaust flow from a cooking chamber of the baking oven, the flow being discharged by a fan. The method includes increasing a speed of the fan during a first time interval after. A first temperature of the baking oven is measured using a first temperature sensor during the first time interval. At the same time a second temperature of the baking oven is measured using a second temperature sensor. An electronic controller is used to determine the temperature difference between the temperatures during the first time interval. At a selected fan speed, the determined temperature difference varies from an initial temperature difference measured at the beginning of the first time interval. The controller sets at least one of the fan speed and a position of a bypass damper as a function of the selected fan speed.

19 Claims, 2 Drawing Sheets

METHOD FOR CONTROLLING THE EXHAUST FLOW FROM A COOKING CHAMBER OF A BAKING OVEN

Priority is claimed to German patent application DE 10 2006 044 039.0, filed Sep. 14, 2006, and which is hereby incorporated by reference herein.

The present invention relates to a method for controlling the exhaust flow from a cooking chamber of a baking oven, the exhaust flow being discharged to the environment by a fan.

BACKGROUND

Baking ovens with cooling fans, on the one hand, protect sensitive components, especially the electronic controller and parts in the vicinity, from overheating and, on the other hand, remove excess steam from the cooking chamber. They also prevent excessive concentrations of steam in the cooking chamber and outflow of steam at sites of leakage. Since different types of baked goods generate different volumes of steam at comparable temperatures, and because steam condensates on cooler surfaces in a manner which strongly depends on the present condition, especially of the baking oven wall, controlling the cooling fan based on the heating power of the oven, or the inside temperature thereof, alone, is not satisfactory.

German Patent Application DE 38 04 678 A1 describes a method for controlling the exhaust flow from a cooking chamber. For this purpose, an exhaust fan is controlled as a function of a temperature measured in the vapor exhaust duct during the cooking process.

A similar method is described in DE 25 18 750 B2.

German Patent Application DE 102 11 522 A1 describes that the speed of a fan for generating an air flow in the cooking chamber can be adjusted between zero and a maximum speed to thereby control the extraction of air from the cooking chamber. It is proposed to use an oxygen sensor for purposes of controlling the exhaust air volume.

German Patent Application DE 102 18 792 A1 describes a method in which a time-varying temperature gradient in the cooking chamber is detected by two temperature sensors so as to subsequently minimize the temperature gradient by heating the cooking chamber.

In order to control the exhaust flow rate by means of the fan, and here by speed control, in a manner that is adapted to the cooking process, it is proposed in EP 1 156 282 to measure, as a control temperature, at least one physical parameter which varies with the pressure difference between the interior of the oven and its environment. This ensures that the fan speed is controlled in a manner that is adapted to the specific cooking process. To this end, the temperature is measured during a period of time, a predetermined setpoint being provided which, when exceeded by the temperature, causes the fan speed to be adjusted upward to the point where the temperature falls below a predetermined setpoint. When another temperature change occurs which is above the upper setpoint, the control of the fan is increased again, and so on.

In this fan speed control method, the fan speed is dependent on the heating temperature in the oven, the temperatures being adjusted downward by the discharge or exhaust flow in a suitable manner, so that the resulting temperature variation during the cooking process occurs between a lower and an upper setpoint.

In order for a cooking appliance to operate in an optimal manner, the extraction of cooking vapors from the cooking chamber should be performed in such a way that no cooking vapors exit the cooking chamber at unwanted sites, air intake openings, or leaks, due to positive pressure. The cooking vapors are intended to be discharged from the baking oven by flow-rate controllable extraction only through the exhaust port that is provided for this purpose and, if present, through the oxidation catalyst located therein. To achieve this, a minimum extraction rate is required. For this purpose, as described, a sensor system determines the required extraction rate. The lower the extraction rate, the lower are the energy losses of the cooking appliance.

Former designs have a disadvantage that the required extraction power is generally not adequately adjusted to the demand. For example, there is the realization that the fan speed is correlated with the baking oven temperature. In this context, it is assumed that the amount of cooking vapors produced in the oven chamber at high temperatures is greater than at low temperatures, and that, therefore, a higher extraction rate is required at high temperatures. However, there is no close correlation with the actual demand. This type of fan speed control is further believed to have the disadvantage that speed control is performed continuously, which, in particular, ties up computing power in the controller.

SUMMARY

It is, therefore, an object of the present invention to provide an alternative method for controlling the exhaust flow from a cooking chamber of a baking oven, which method is closely correlated with the demand and which does not require an additional opening in the cooking chamber.

In an embodiment, the present invention provides a method for controlling the exhaust flow from a cooking chamber of a baking oven, the flow being discharged by a fan. The method includes increasing a speed of the fan during a first time interval after a predetermined heat up phase of a cooking process. A first temperature is measured using a first temperature sensor at a first location of the baking oven during the first time interval. At the same time a second temperature is measured using a second temperature sensor at a second location of the baking oven during the first time interval. An electronic controller is used to determine a temperature difference between the first temperature and the second temperature during the first time interval. At the beginning of the first time interval the controller determines an initial temperature difference. However, at a selected fan speed, the determined temperature difference varies from the initial temperature. The controller sets at least one of the fan speed and a position of a bypass damper as a function of the selected fan speed.

In another embodiment, the invention provides a baking oven with a cooking chamber, a fan for removing exhaust air from the cooking chamber through an exhaust conduit, a bypass damper disposed in the exhaust conduit, first and second temperature sensors and an electronic controller. The first temperature sensor is disposed in a first location in the baking oven and is configured to measure a first temperature of the cooking chamber during a first time interval. The second temperature sensor is disposed in a second location of the baking oven and is configured to measure a second temperature of the cooking chamber during the first time interval. The electronic controller includes an evaluation circuit that determines a temperature difference between the first temperature and the second temperature and a memory. The electronic controller is configured to increase a speed of the fan during the first time interval and determine a selected fan speed at which the determined temperature difference varies from an initial temperature difference during the first time interval. The controller sets at least one of the fan speed and a position of the bypass damper during a second time interval as a function of the determined selected fan speed.

BRIEF DESCRIPTION OF THE DRAWINGS

The present invention will be explained, based on exemplary embodiments, in more detail with reference to the following FIGS. 1 through 4, of which.

DETAILED DESCRIPTION

Figure 1:
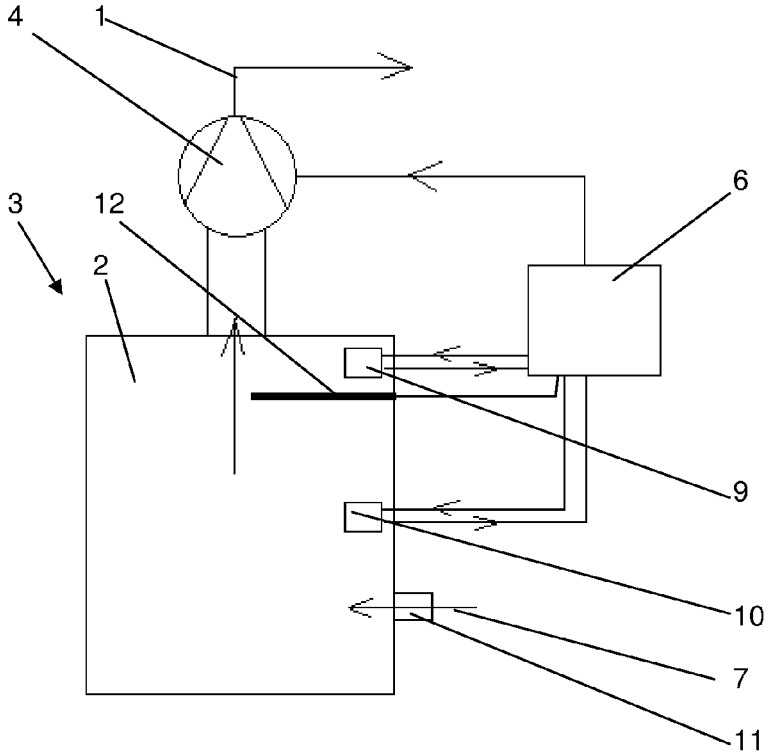
FIG. 1 is a first block diagram of the control of the exhaust flow from a cooking chamber of a baking oven with two temperature sensors.

The present invention proposes a method in which, in order to control the exhaust flow from the cooking chamber of a baking oven, a first temperature sensor automatically measures a first temperature T1 and a second temperature sensor automatically measures a second temperature T2 during a first time interval in the cooking process. The measurements are made substantially simultaneously at different locations in the cooking chamber, so that the temperature difference between T1 and T2 is determined in an electric controller of the baking oven. The fan speed, or the opening degree of a bypass damper for varying the exhaust flow produced by the fan, is determined as a function of the temperature difference, and, in a subsequent second time interval, the determined speed of the fan, or the opening degree of the bypass damper, is maintained substantially constant. The two time intervals are alternatingly repeated during the cooking process.

In order to determine the extraction rate required at a particular point in time, the extraction rate is varied in the first time interval between low and high values. Thus, the system starts at a low extraction rate. If the temperature difference between the two temperature sensors in the cooking chamber does not initially change, then no cold ambient kitchen air is being drawn into the cooking chamber through the air intake openings. The temperature difference does not begin to change until extraction takes place at a rate sufficient to cause cold ambient kitchen air to be drawn into the cooking chamber. The cooking chamber temperature is maintained at its value by a controller and a heating element associated therewith. The cool air now drawn into the cooking chamber affects the second temperature sensor to a greater or lesser degree than the first temperature sensor. That is, the temperature difference between the two increases or decreases. The question of whether the temperature difference increases or decreases depends on how the temperature difference is calculated. When varying the extraction power, the temperature difference may not change until extraction takes place at a rate sufficient to cause cold ambient kitchen air to be drawn into the cooking chamber through leaks or air intake openings. The degree of vapor extraction at the so-identified point, which is just sufficient to cause cool ambient kitchen air to be drawn into the cooking chamber, is maintained as an orientation threshold for a second time interval, for example, over a period of several minutes. In one embodiment the period is 10 minutes. At this point the system checks again whether the current extraction power is optimal; i.e., a new first time interval is started. Optionally, the electronics may have stored therein a setting which determines the required cooking vapor extraction rate for the subsequent second time interval as a function of said threshold. This may be, for example, at the identified threshold, or slightly below or above it. After the second time interval, a new first time interval is started in order to determine the extraction rate required for the next second time interval, and so on.

This results in temperature T1 of the first temperature sensor, which is connected to the temperature controller, being constant. If the differential temperature, delta, is defined to be temperature T2 minus T1, then the result is T2 minus a constant. Accordingly, a smaller T2 corresponds to a smaller difference. In order to control the temperature of the cooking appliance, a temperature T1 is measured by a temperature sensor. This temperature sensor is typically located near the grill element in the upper portion of the cooking chamber. The intention is to adjust the temperature at the center of the cooking chamber to the user-set value with the aid of T1. Since T1 is much closer to the heating element than to the center of the cooking chamber, T1 and the temperature at the center of the cooking chamber are sometimes very different, for example, during operation.

The difference is referred to as the offset. Generally, the offset is stored in the memory of the electronics for each operating mode and for each desired oven temperature, i.e., the set temperature for the cooking chamber. The exhaust fan starts upon detection of the appropriate exhaust fan speed, at a low speed, or at zero speed. A second temperature T2 is measured at the center of the cooking chamber, or at a different position. Typically, the values of T1 and T2 are not equal. When increasing the exhaust fan speed, T2 initially remains constant. Since T2 has a different geometric position relative to the heating elements and to the fresh air streams in the cooking chamber, it usually has a different value than T1. During the process of changing the exhaust fan speed, T1 remains unchanged or, in other words, the heating is controlled in such a manner that T1 remains constant, which is the task of the oven temperature controller. As long as no cold air is drawn into the cooking chamber through cooking chamber openings, T2 remains at the initial value at a low fan speed. When the exhaust fan power, i.e., the fan speed, reaches a level at which the system begins to draw cold air into the cooking chamber, in addition to extracting the cooking vapors that are generated, temperature T2 changes. The delta between T2 and T1 changes. The change in the delta is positive or negative, depending on the flow conditions of the cold air drawn into the cooking chamber. The sign of the change is irrelevant to the identification of the required extraction power. It is only important to identify the change in the delta between T2 and T1. Thus, the principle for detecting the sought threshold is to initially monitor an exhaust-fan-power-independent T2 value. When the sought extraction power is reached during the increase of the fan speed, T2 begins to change with respect to its initial value that existed at the low initial fan speed at the beginning of the respective detection time interval of the respective first time interval. The question of how large the difference from the initial value must be in order to be definitely and reliably detected as a change has been dealt with. For example, the system could be set to detect a change when T2 differs from its stable initial value by 10 percent. Then, when the threshold was exceeded, extraction takes place at a rate sufficient to cause cold air to be drawn into the cooking chamber. The extraction takes place at a rate sufficient to prevent positive pressure from being created by the cooking vapors in the cooking chamber. The expected change in the temperature difference depends on the operating mode, oven temperature T1, and on the mounting positions of the temperature sensors for measuring T1 and T2.

The advantageous effect that ensures that cooking vapors are extracted in a manner that is adjusted to demand, while keeping energy consumption to a minimum and providing for optimum extraction, is achieved by the use of only one additional temperature sensor provided within the cooking chamber for sensing purposes without requiring any additional measuring apertures in the cooking chamber.

In a refinement of the present invention, the temperature difference between the two temperatures T1 and T2 is determined for the first time after the elapse of a predetermined heat-up phase during the cooking process, and the duration of the first time interval is selected to be so short that the temperature difference between T1 and T2 in the cooking chamber would remain substantially constant during the first time interval, given a constant exhaust flow rate.

During the first time interval, the fan speed is automatically increased in a continuous or stepwise manner, starting from a low speed at which only part of the vapors produced during the cooking process is discharged, as an exhaust flow, by the fan to the environment. The exhaust flow is increased until the temperature difference between T1 and T2 is different from an initial temperature difference (T1 minus T2 or T2 minus T1) measured at the beginning of the first time interval. At this point, the fan speed, or the opening degree of a bypass damper, is automatically set for the second time interval as a function of the last speed.

In one embodiment, the first temperature sensor measures temperature T1 of the exhaust air from the cooking chamber, and the second temperature sensor measures temperature T2 in the lower portion of the cooking chamber. During the first time interval, temperature T1 is maintained substantially constant with the aid of cooking chamber heating means and a temperature controller.

In accordance with another embodiment of the invention, a baking oven for carrying out the method is provided in which, in order to control the exhaust flow, a second temperature sensor for measuring a second temperature T2 of the cooking chamber is disposed on or in the baking oven. The two temperature sensors may be arranged in such a manner that temperatures T1 and T2 can be measured at two different locations in the cooking chamber, and that a temperature difference can be determined from the two temperatures T1 and T2 in the evaluation circuit, and the fan speed, or the opening degree of a bypass damper which is disposed in the exhaust conduit and is in signal communication with the electric controller, may be automatically adjustable as a function of said temperature difference.

The first temperature sensor may be disposed in the upper portion of the cooking chamber, and the second temperature sensor may be disposed in the lower portion of the cooking chamber. The first temperature sensor interacts with the cooking chamber heating means in a manner that allows temperature T1 to be substantially controlled to a substantially constant value during the first time interval.

FIG. 1 shows, in a block diagram, the control of an exhaust flow 1 from cooking chamber 2 of a baking oven 3 to the environment, which flow control is provided by a fan 4. Speed 5 is controlled as a function of the measurement of the temperature difference between T1 and T2 which is measured by temperature sensors 9 and 10 in cooking chamber 2 of baking oven 3. To this end, electronics 6 are provided between fan 4 and temperature sensors 9 and 10, the electronics 6 processing the sensor signals for speed control purposes. Fresh air 7 may enter cooking chamber 2 due to leaks. First temperature sensor 9 is disposed in the upper portion of the cooking chamber. Second temperature sensor 10 is disposed in the cooking chamber at a different position than first temperature sensor 9 in order to detect a temperature difference delta T between the two temperature sensors 9 and 10.

Figure 2:
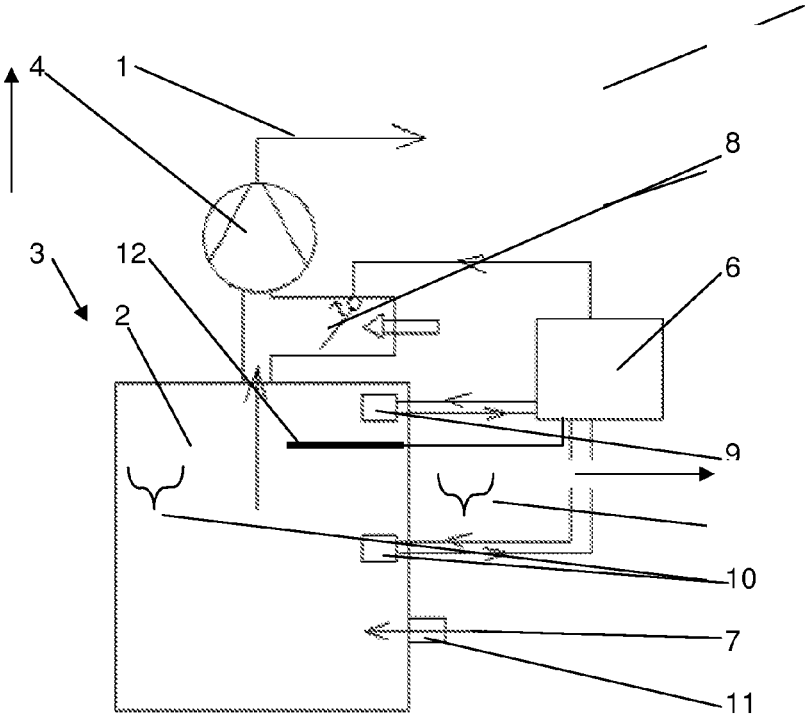
FIG. 2 shows another embodiment which is similar to that of FIG. 1, but has a bypass damper.
Figure 3:
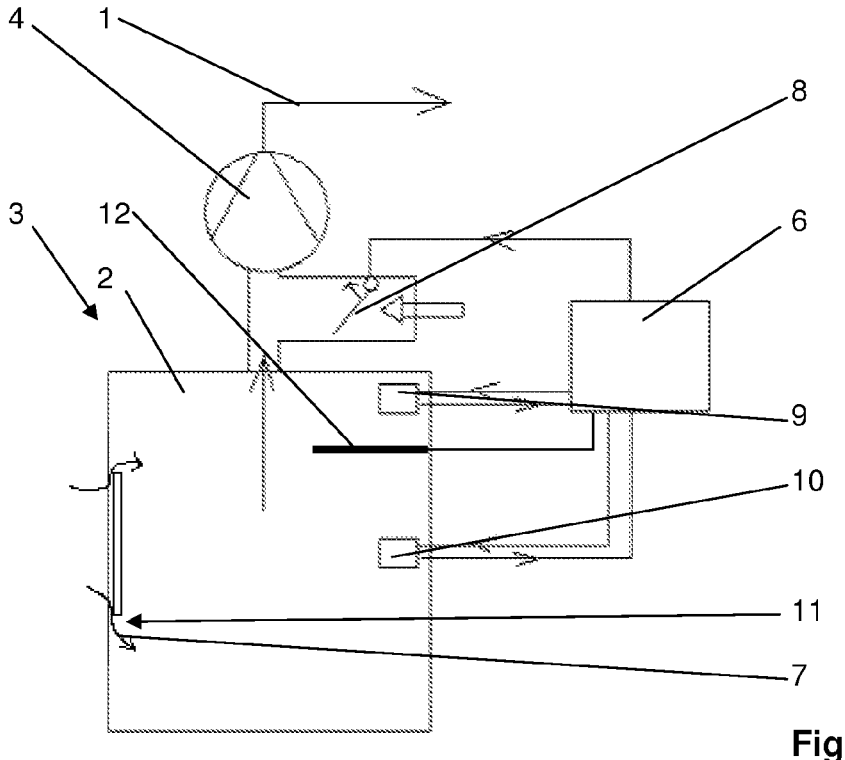
FIG. 3 shows another embodiment which is similar to that shown in FIG. 2.

Electronics 6 for varying the rate of exhaust flow 1 may be used, for example, to control the speed of fan 4 or the opening degree of a bypass damper 8 (shown in FIG. 2) on the intake side of fan 4, as is shown also in FIG. 3. An air intake opening 11 may be a structural opening through which the cool ambient kitchen air can be drawn into cooking chamber 2 during the extraction of cooking vapors from cooking chamber 2. However, air intake opening 11 may also be one or more almost inevitable air leaks in baking oven 3, such as gaps in the region of the door or in the region of the lamp seal, or at the penetrations for a heating element of a cooking chamber heating means 12. This is shown especially in FIG. 3.

In the described embodiment of the method, a first temperature sensor 9 automatically measures a first temperature T1 and a second temperature sensor 10 automatically measures a second temperature T2 during a first time interval in the cooking process. The temperature measurements are made substantially simultaneously at different locations in cooking chamber 2. The first time interval corresponds to a measurement cycle I (illustrated in FIG. 4). The temperature difference between T1 and T2 is determined in electric controller 6 of baking oven 3. Further, speed 5 of fan 4, or the opening degree of a bypass damper 8 for varying the exhaust flow 1 produced by fan 4, is determined as a function of the temperature difference. In a subsequent second time interval, for example the time interval between "I" and "II" in FIG. 4, the determined speed of fan 4, or the opening degree of bypass damper 8, is maintained substantially constant, the two time intervals being alternatingly repeated during the cooking process. This design especially saves computing power because the measurement is made only in the shorter time interval, i.e., the first time interval.

The temperature difference between the two temperatures T1 and T2 is determined for the first time after the elapse of a predetermined heat-up phase during the cooking process. The duration of the first time interval is selected to be so short that the temperature difference between T1 and T2 in cooking chamber 2 would remain substantially constant during the first time interval, given a constant exhaust flow rate 1. During the first time interval (see "I" in FIG. 4), speed 5 of fan 4 is automatically increased in a continuous or stepwise manner, starting from a low speed at which only part of the vapors produced during the cooking process is discharged, as an exhaust flow 1, by fan 4 to the environment The speed is subsequently increased until the temperature difference between T1 and T2 is different from an initial temperature difference measured at the beginning of the first time interval. The speed of fan 4, or the opening degree of bypass damper 8, is automatically set for the second time interval (see the time interval between "I" and "II" in FIG. 4) as a function of the determined speed.

First temperature sensor 9 measures temperature T1 of the exhaust air from the cooking chamber, while second temperature sensor 10 measures temperature T2 in the lower portion of the cooking chamber. During the first time interval, temperature T1 is maintained substantially constant with the aid of cooking chamber heating means 12 and a temperature controller.

Figure 4:
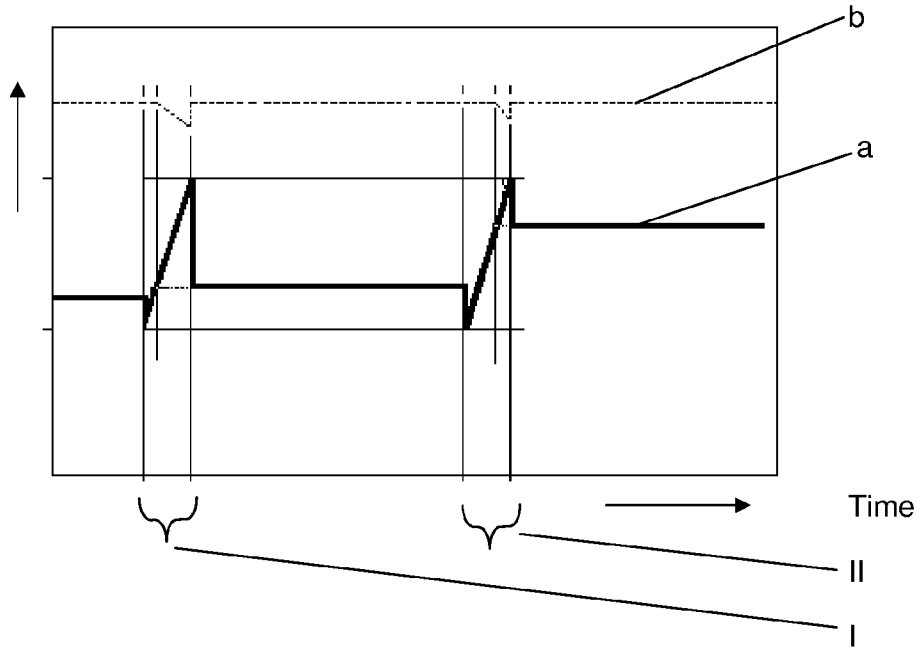
FIG. 4 is a diagram showing different measurement cycles over time.

FIG. 4 shows the change over time of exhaust flow 1 and of the differential temperature between T1 and T2 during the first time interval (see also "I" and "II" in FIG. 4). In both examples, the temperature difference is reduced by cold fresh air 7.

In FIG. 4, an exemplary profile of the rate of exhaust flow 1 is represented by a curve a and the profile of the differential temperature is represented by a curve b, the profile of the rate of exhaust flow 1 corresponding to the profile of the fan speed of fan 4. FIG. 4 illustrates that, during the first time interval shown here by way of example, the fan speed, and thus the rate of exhaust flow 1, is continuously increased, starting from an initial low speed (see curve a). At the beginning of the first time interval, and also during the first phase of speed increase, the differential temperature (curve b) remains substantially constant. The orientation threshold for the speed of fan 4 for the second time interval immediately following the exemplary first time interval is found when the speed, and thus the rate of exhaust flow 1, reaches a value just sufficient to cause cold ambient kitchen air 7 to be drawn into cooking chamber 2 through air intake opening 11. This point is shown in FIG. 4 by the beginning decrease in the differential temperature, curve b. If a small amount of cooking vapors is produced in cooking chamber 2, a relatively low fan speed or, respectively, a relatively low exhaust flow rate 1 is obtained for the orientation threshold, whereas if a large amount of cooking vapors is produced in cooking chamber 2, the orientation threshold, and thus the fan speed, is higher (see FIG. 4). It is possible to use the same duration for each first time interval during a cooking process, as is shown in FIG. 4. However, for reasons of saving time and optimizing the extraction of cooking vapors from cooking chamber 2, it is advantageous to terminate the respective first time interval once the orientation threshold for the speed of fan 4 has been determined for the second time interval in the aforementioned manner. On the other hand, it is convenient to use the same duration for the second time intervals.

The present invention also relates to a baking oven 3 for carrying out the inventive method. Baking oven 3 has a fan 4 for removing exhaust air 1 from cooking chamber 2 through an exhaust conduit to the environment, and an electric controller 6 which has an evaluation circuit and a memory and is in signal communication with first temperature sensor 9 and fan 4. In order to control exhaust flow 1, a second temperature sensor 10 for measuring a second temperature T2 of the cooking chamber is disposed on or in the baking oven, the two temperature sensors 9 and 10 being arranged in such a manner that temperatures T1 and T2 can be measured at two different locations in cooking chamber 2, and that a temperature difference can be determined from the two temperatures T1 and T2 in the evaluation circuit, and speed 5 of fan 4, or the opening degree of a bypass damper 8 which is disposed in the exhaust conduit and is in signal communication with electric controller 6, being automatically adjustable as a function of said temperature difference.

As can be seen in the figures, first temperature sensor 9 is disposed in the upper portion of cooking chamber 2, and second temperature sensor 10 is disposed in the lower portion of cooking chamber 2. In a refinement, first temperature sensor 9 interacts with cooking chamber heating means 12 in such a manner that temperature T1 is substantially controlled to a constant value during the first time interval.

What is claimed is:

1. A method for controlling the exhaust flow from a cooking chamber of a baking oven, the flow being discharged by a fan, the method comprising the steps:

increasing a speed of the fan during a first time interval after a predetermined heat up phase of a cooking process;

measuring a first temperature at a first location of the baking oven using a first temperature sensor during the first time interval;

measuring a second temperature at a second location of the baking oven using a second temperature sensor at a same time as the measuring of the first temperature during the first time interval;

determining a temperature difference between the first temperature and the second temperature using an electronic controller of the baking oven;

determining a selected fan speed at which the determined temperature difference varies from an initial temperature difference, the initial temperature difference being the determined temperature difference at the beginning of the first time interval; and setting at least one of the fan speed and a position of a bypass damper during a second time interval as a function of the determined selected fan speed.

2. The method as recited in claim 1, wherein the first and second locations are different.

3. The method as recited in claim 1, wherein the first temperature corresponds to a temperature of exhaust air from the cooking chamber and the second location is in a lower portion of the cooking chamber.

4. The method as recited in claim 1, further comprising maintaining the first temperature substantially constant during the first time interval using a cooking chamber heating element and a temperature controller.

5. The method as recited in claim 1 further comprising:

increasing the speed of the fan during a third time interval of the cooking process;

measuring a third temperature using the first temperature sensor during the third time interval;

measuring a fourth temperature using the second temperature sensor at a same time as the measuring of the third temperature during the third time interval;

determining another temperature difference between the third temperature and the fourth temperature using the electronic controller;

determining another selected fan speed at which the other determined temperature difference varies from another initial temperature difference, the other initial temperature difference being the other temperature difference determined at the beginning of the third time interval; and setting at least one of the fan speed and the position of the bypass damper during a fourth time interval as a function of the other determined selected fan speed.

6. The method as recited in claim 1, wherein the second time interval is longer than the first time interval.

7. The method as recited in claim 1, further comprising selecting a duration of the first time interval such that the difference in temperature would be constant given a constant rate of the exhaust flow.

8. The method as recited in claim 1 wherein the set fan speed is within 10% of the selected fan speed.

9. The method as recited in claim 1 wherein the increasing is performed so as to increase the fan speed from a low fan speed at which only a part of vapors produced during the cooking process is discharged from the baking oven to a last fan speed which is the determined selected fan speed.

10. The method as recited in claim 1 wherein the fan speed is increased in at least one of a continuous and stepwise manner during the first time interval.

11. A baking oven comprising:

a cooking chamber;

a fan for removing exhaust air from the cooking chamber through an exhaust conduit;

a bypass damper disposed in the exhaust conduit;

a first temperature sensor disposed in a first location of the baking oven and configured to measure a first temperature of the cooking chamber during a first time interval;

a second temperature sensor disposed in a second location of the baking oven and configured to measure a second temperature of the cooking chamber during the first time interval; and an electronic controller having an evaluation circuit and a memory, the electronic controller configured to:

increase a speed of the fan during the first time interval, determine a temperature difference between the first temperature and the second temperature using the evaluation circuit, determine a selected fan speed at which the determined temperature difference varies from an initial temperature difference, the initial temperature difference being the determined temperature difference at the beginning of the first time interval, and set at least one of the fan speed and a position of the bypass damper during a second time interval as a function of the determined selected fan speed.

12. The baking oven recited in claim 11, wherein the first temperature sensor is disposed in an upper portion of the cooking chamber and the second temperature sensor is disposed in a lower portion of the cooking chamber.

13. The baking oven recited in claim 11, further comprising a heating element, and wherein the electronic controller is further configured to control the heating element such that the first temperature is maintained at a constant value during the first time interval.

14. The baking oven recited in claim 11, wherein the first temperature corresponds to a temperature of exhaust air from the cooking chamber, and the second location is in a lower portion of the cooking chamber.

15. The baking oven recited in claim 11, wherein the first temperature sensor is further configured to measure a third temperature during a third time interval, the second temperature sensor is configured to measure a fourth temperature during a third time interval, and the electronic controller is further configured to:

increase a speed of the fan during the third time interval, determine another temperature difference between the third temperature and the fourth temperature using the evaluation circuit, determine another selected fan speed at which the other determined temperature difference varies from another initial temperature difference, the other initial temperature difference being the other determined temperature difference at a beginning of the third time interval, and set at least one of the fan speed and a position of the bypass damper during a fourth time interval as a function of the other determined selected fan speed.

16. The baking oven recited in claim 11, wherein the second time interval is longer than the first time interval.

17. The baking oven recited in claim 11, wherein a duration of the first time interval is such that the difference in temperature would be constant given a constant rate of the exhaust flow.

18. The baking oven recited in claim 11, wherein the set fan speed is within 10% of the selected fan speed.

19. A method for controlling the exhaust flow from a cooking chamber of a baking oven, the flow being discharged by a fan, the method comprising the steps:

increasing a speed of the fan during a first time interval after a predetermined heat up phase of a cooking process;

measuring a first temperature at a first location of the cooking chamber using a first temperature sensor during the first time interval;

measuring a second temperature at a second location of the cooking chamber using a second temperature sensor at a same time as the measuring of the first temperature during the first time interval, the second temperature sensor being disposed at a different location than the first temperature sensor in the baking oven;

determining a temperature difference between the first temperature and the second temperature using an electronic controller of the baking oven;

selecting a duration of the first time interval such that the difference in temperature would be constant given a constant rate of the exhaust flow;

determining a selected fan speed at which the determined temperature difference varies from an initial temperature difference, the initial temperature difference being the determined temperature difference at the beginning of the first time interval; and setting at least one of the fan speed and a position of a bypass damper during a second time interval as a function of the determined selected fan speed.

* * * * *